US008782815B2

(12) United States Patent
Greene, Jr.

(10) Patent No.: US 8,782,815 B2
(45) Date of Patent: Jul. 22, 2014

(54) WIND-STABILIZED BASEBALL CAP

(76) Inventor: Thomas H. Greene, Jr., Madison County, FL (US)

( * ) Notice: Subject to any disclaimer, the term of this patent is extended or adjusted under 35 U.S.C. 154(b) by 0 days.

(21) Appl. No.: 13/468,087

(22) Filed: May 10, 2012

(65) Prior Publication Data

US 2013/0239292 A1 Sep. 19, 2013

Related U.S. Application Data

(63) Continuation-in-part of application No. 12/154,562, filed on May 23, 2008, now abandoned.

(51) Int. Cl.
*A42B 1/04* (2006.01)

(52) U.S. Cl.
USPC ..... 2/195.1; 2/171.3

(58) Field of Classification Search
USPC ..... 2/195.1, 195.6, 7, 171.2, 171.4, 171.5, 2/172, 171, 184.5, 209.12, 209.13, 175.1, 2/175.6
See application file for complete search history.

(56) References Cited

U.S. PATENT DOCUMENTS

| | | | | | |
|---|---|---|---|---|---|
| 1,194,935 | A | * | 8/1916 | Bell | 2/184.5 |
| 2,874,387 | A | * | 2/1959 | Bannister et al. | 2/195.1 |
| 3,927,421 | A | * | 12/1975 | Simon | 2/12 |
| D246,272 | S | * | 11/1977 | Bay | D29/109 |
| 4,292,689 | A | * | 10/1981 | Townsend, Jr. | 2/12 |
| 5,093,937 | A | * | 3/1992 | Kamata | 2/424 |
| 5,487,191 | A | * | 1/1996 | Ridley | 2/195.1 |
| 5,781,933 | A | * | 7/1998 | De Giacomi | 2/195.1 |
| 6,088,837 | A | * | 7/2000 | Baker | 2/195.1 |
| 6,237,156 | B1 | * | 5/2001 | Ellman et al. | 2/195.1 |
| 6,308,336 | B1 | * | 10/2001 | Stephenson et al. | 2/209.13 |
| 6,311,331 | B1 | * | 11/2001 | Park | 2/195.1 |
| 6,314,583 | B1 | * | 11/2001 | Cho | 2/195.1 |
| 6,745,395 | B2 | * | 6/2004 | Noble | 2/12 |
| 7,082,618 | B1 | * | 8/2006 | Muso | 2/175.1 |
| 2004/0231033 | A1 | * | 11/2004 | Cho | 2/195.1 |
| 2006/0005302 | A1 | * | 1/2006 | Stephenson | 2/410 |

* cited by examiner

*Primary Examiner* — Richale Quinn
(74) *Attorney, Agent, or Firm* — J. Wiley Horton

(57) ABSTRACT

A baseball cap including features for stabilizing the cap in a moving stream of air. The cap includes a modified bill having a downforce generator configured to create a relatively stagnate recirculation zone between the downforce generator and the head covering. This recirculation zone tends to negate the lifting effect found in prior art bills. The invention preferably includes a vent through the bill. The vent is located behind the downforce generator, to connect the underside of the bill to the recirculation zone formed in the wake of the downforce generator. The vent is selectively closed by a flexible flap. The flap remains closed to prevent rain from passing through the vent. However, if pressure beneath the bill significantly exceeds pressure above the bill, the vent opens to equalize the pressure. This action prevents the creation of a net lifting force which might lift the cap off the wearer's head.

2 Claims, 8 Drawing Sheets

WIND-STABILIZED BASEBALL CAP

CROSS-REFERENCES TO RELATED APPLICATIONS

This application is a continuation in part of U.S. patent application Ser. No. 12/154,562, which was filed on May 23, 2008 now abandoned. The parent application listed the same inventor.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of headwear. More specifically, the invention comprises a baseball cap having a modified bill configured to produce downforce when the cap is placed in a moving airstream.

2. Description of the Related Art

The "baseball cap" is one of the world's best known hats. FIG. 1 shows a typical example. Baseball cap 10 is comprised of head covering 12 and bill 14. Head covering 12 is a generally circular assembly of flexible material sized to fit fairly closely over the human head. Bill 14 has leading edge 52 and trailing edge 54. The trailing edge is attached to the forward portion of the head covering. As the hat is normally worn, the bill extends forward from the wearer's face. The bill provides shade and weather protection for the user's face.

Those familiar with the art will know that such hats are made using a variety of technique. The example of FIG. 1 is constructed using a sewn assembly of wedge-shaped pieces. These are curved inward and join at the top, where a button is usually affixed. Such hats must typically include size-adjusting features. The rear of the hat may have a break spanned by an adjustable strap. The strap is used to adjust the circumference of the hat at its largest section. Alternatively, the head covering may include elastic material which eliminates the need for other adjustment features.

FIG. 2 shows an elevation view of a person actually wearing a prior art baseball cap. Such caps are often worn while traveling in an open vehicle—such as a fishing boat. Air flow directed toward the wearer's face has a tendency to lift the baseball cap off the wearer's head. As for most situations involving subsonic compressible flow, the phenomenon is explained by the application of Bernoulli's equation, which can be written as:

$$\frac{1}{2}v_1^2 + gh_1 + \frac{P_1}{\rho_1} = \frac{1}{2}v_2^2 + gh_2 + \frac{P_2}{\rho_2}$$

In this expression, v stands for the flow velocity at a given point, g stands for gravitational acceleration, h stands for the height above a reference plane, P stands for the pressure of the air at a given point, and ρ stands for the density of the air at a given point.

From this equation one may easily discern the fact that when a compressible fluid is flowing past an object at subsonic speeds, the faster the flow is sin a particular region the lower the pressure will be in that region. When looking at FIG. 2, the reader will observe how the flow must split to flow over the top and bottom of bill 14. The flow over the top passes smoothly over the head covering and is not decelerated very much. This is denoted in the view as high velocity region 18.

The flow passing under the bill, however, impacts the wearer's face 16. This produces a recirculation area denoted as stagnation region 20. The flow in this area is relatively slow. Thus, from Bernoulli's equation, one may accurately predict that the air pressure in the area beneath the bill will be greater than the air pressure in the area above the bill. The result is the creation of lift 24, which tends to lift the cap free of the wearer's head.

Prior hat designers have accounted for this phenomenon by angling the bill downward as shown. The downward angle has the effect of an airfoil having a negative angle of attack. The flow over the top therefore creates downforce 22. If the magnitude of downforce 22 exceeds that of lift 24, then the hat will stay on. Of course, the motion of the wearer's head alters the bill's angle of attack. If the user inclines her head slightly, downforce 22 will be greatly reduced. This will likely be the instant when the moving airstream lifts the cap free of the wearer's head and carries it away.

The loss of such a cap is a significant inconvenience. This is particularly true in a boating situation, where the hat is likely to blow overboard and be lost. Prior art designers have attempted to remedy this known problem in a variety of ways. For example, some caps have incorporated a bill having a hinged vent flap. The vent flap pivots upward if the pressure difference between the region beneath the bill and above the bill becomes large enough. Other designs have incorporated one or more fixed vents through the bill. Still other designs have incorporated a bill with a severe downward angle, so that the bill's angle of attack remains negative throughout the range of motion of the user's head.

While these prior art designs have in part remedied the problem, no prior art design has produced a good solution while still maintaining the conventional benefits of the traditional baseball cap. The present invention seeks to remedy these shortcomings.

BRIEF SUMMARY OF THE PRESENT INVENTION

The present invention is a baseball cap including features for stabilizing the cap in a moving stream of air. The cap includes a modified bill having a downforce generator configured to create a relatively stagnate recirculation zone between the downforce generator and the head covering. This recirculation zone tends to negate the lifting effect found in prior art bills.

The invention preferably also includes a vent through the bill. The vent is located behind the downforce generator, so as to connect the underside of the bill to the recirculation zone formed in the wake of the downforce generator. The vent is selectively closed by a flexible flap. The flap remains closed to prevent rain from passing through the vent. However, if pressure beneath the bill significantly exceeds pressure above the bill, the vent opens to equalize the pressure. This action prevents the creation of a net lifting force which might lift the cap off the wearer's head.

REFERENCE NUMERALS IN THE DRAWINGS

| | | | |
|---|---|---|---|
| 10 | baseball cap | 12 | head covering |
| 14 | bill | 16 | face |
| 18 | high velocity region | 20 | stagnation region |
| 22 | downforce | 24 | lift |
| 26 | stay-on cap | 28 | modified bill |
| 30 | downforce generator | 32 | splitter |
| 34 | vent | 36 | flap |
| 38 | drain | 40 | upper pressure |
| 42 | lower pressure | 44 | flap attachment |
| 46 | free end | 48 | secondary downforce |
| 50 | forward region | 52 | leading edge |
| 54 | trailing edge | 56 | gap |
| 58 | cavity | 60 | first lateral extreme |
| 62 | second lateral extreme | 64 | trailing portion |
| 66 | closing pressure | 68 | throat |
| 70 | exit | | |

DETAILED DESCRIPTION OF THE INVENTION

The central concept of the present invention is to provide a system that prevents moving air from forcing a cap off a wearer's head by providing an uplifting force on the cap's bill. At the same time, the system should retain the normal sun shading and moisture channeling capabilities of a conventional cap. In order to achieve these objectives, the invention features a vent through the bill which is selectively opened and closed by a moveable flap.

The flap operates in conjunction with a downforce generator located on top of the bill. The geometry of the vent, the flap, the cap, and the downforce generator combine to selectively create (1) a first state in which the flap opens to allow flow through the bill when needed to keep the hat in place; and (2) a second state in which the flap is forced closed in order to restore the normal functions of the bill. The automatic transfer between these two states is referred to as "active load relief," meaning that the cap automatically changes its configuration in order to hold the cap in position on the wearer's head.

Figure 1:
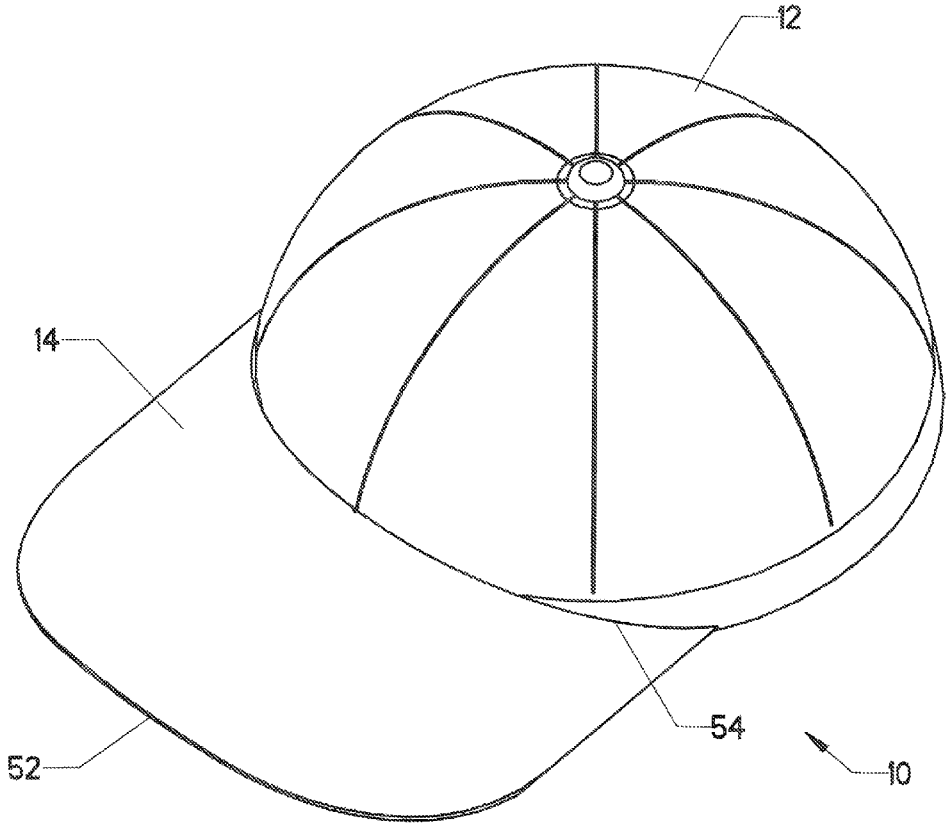
FIG. 1 (PRIOR ART)
FIG. 1 is a perspective view, showing a prior art baseball cap.
Figure 2:
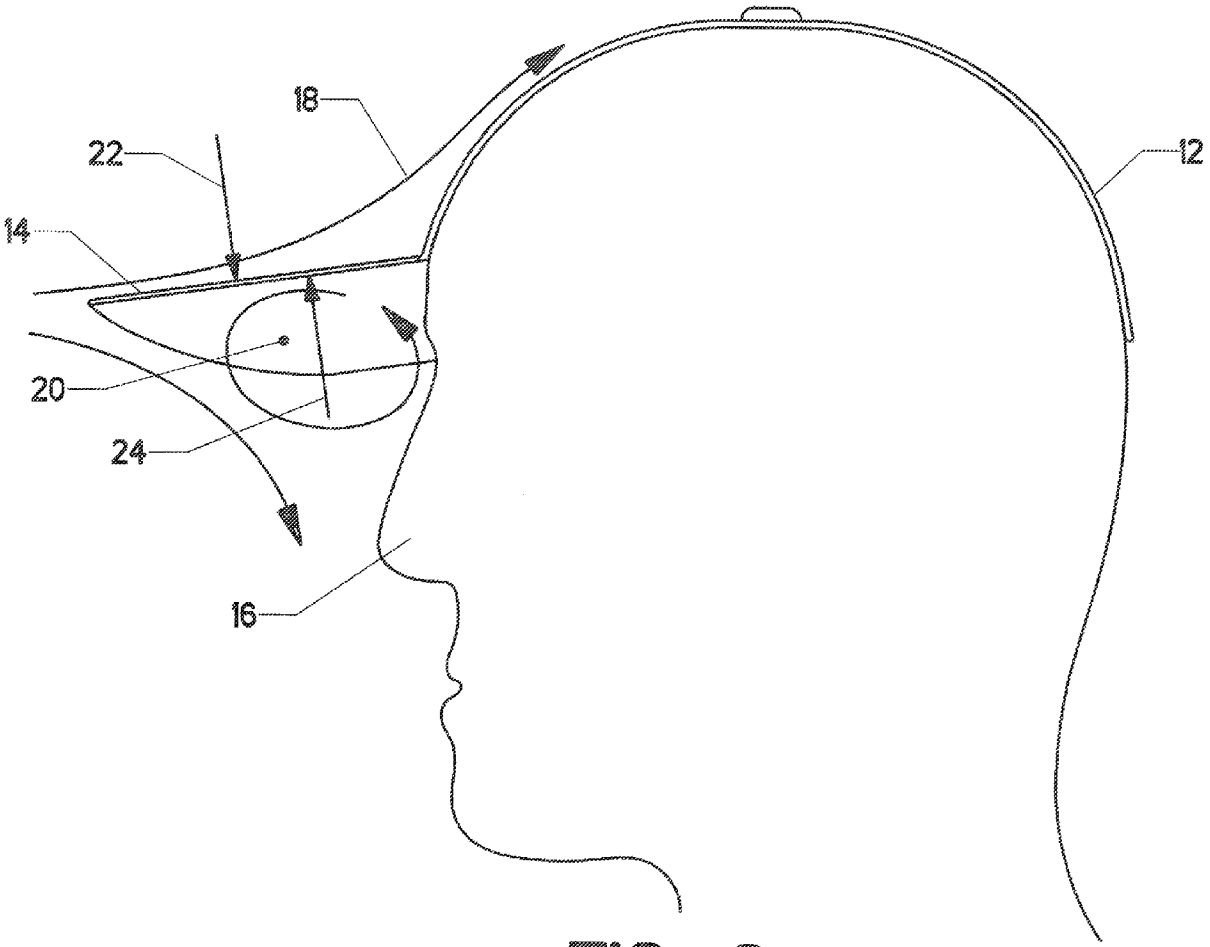
FIG. 2 (PRIOR ART)
FIG. 2 is a side elevation view, showing the flow of air over a prior art baseball cap.
Figure 3:
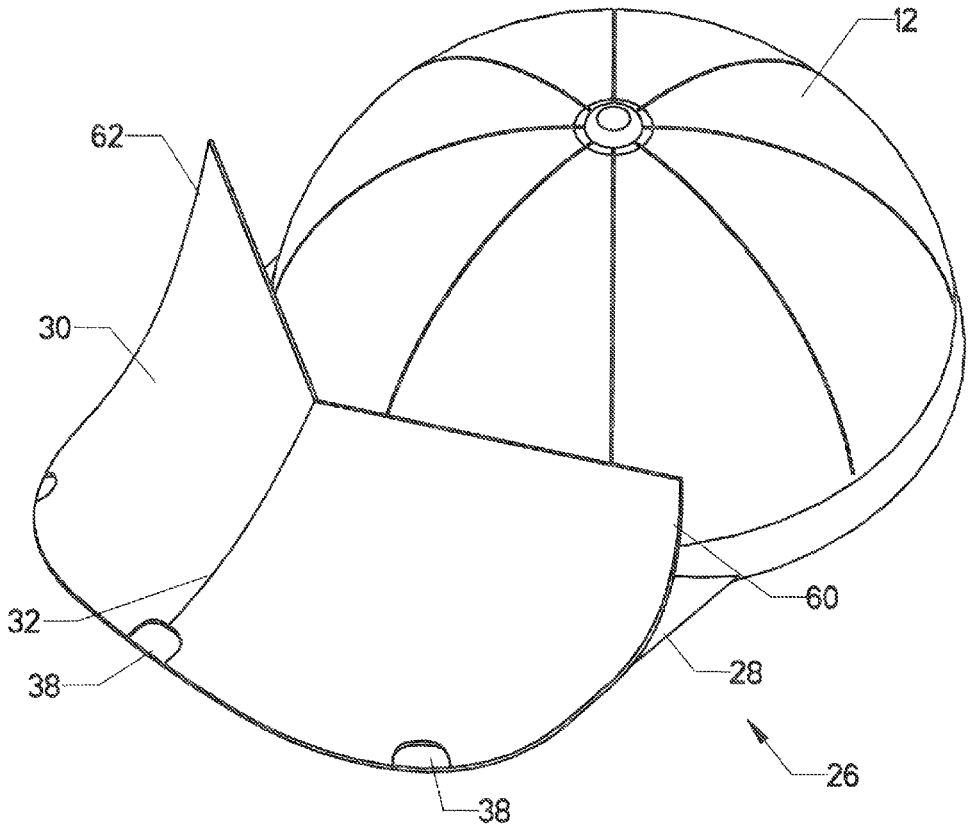
FIG. 3 is a perspective view, showing the present invention.

FIG. 3 shows the present invention in an assembled state. Stay-on cap 26 has modified bill 28. Downforce generator 30 is preferably attached to modified bill 28. The reader will observe how the downforce generator preferably assumes a form reminiscent of a snow plow blade. Splitter 32 preferably lies near the middle of the downforce generator. Air flow impacting the downforce generator strikes the splitter and is thereafter divided into a first portion directed toward a first lateral extreme 60 and a second portion directed toward a second lateral extreme 62.

Figure 4:
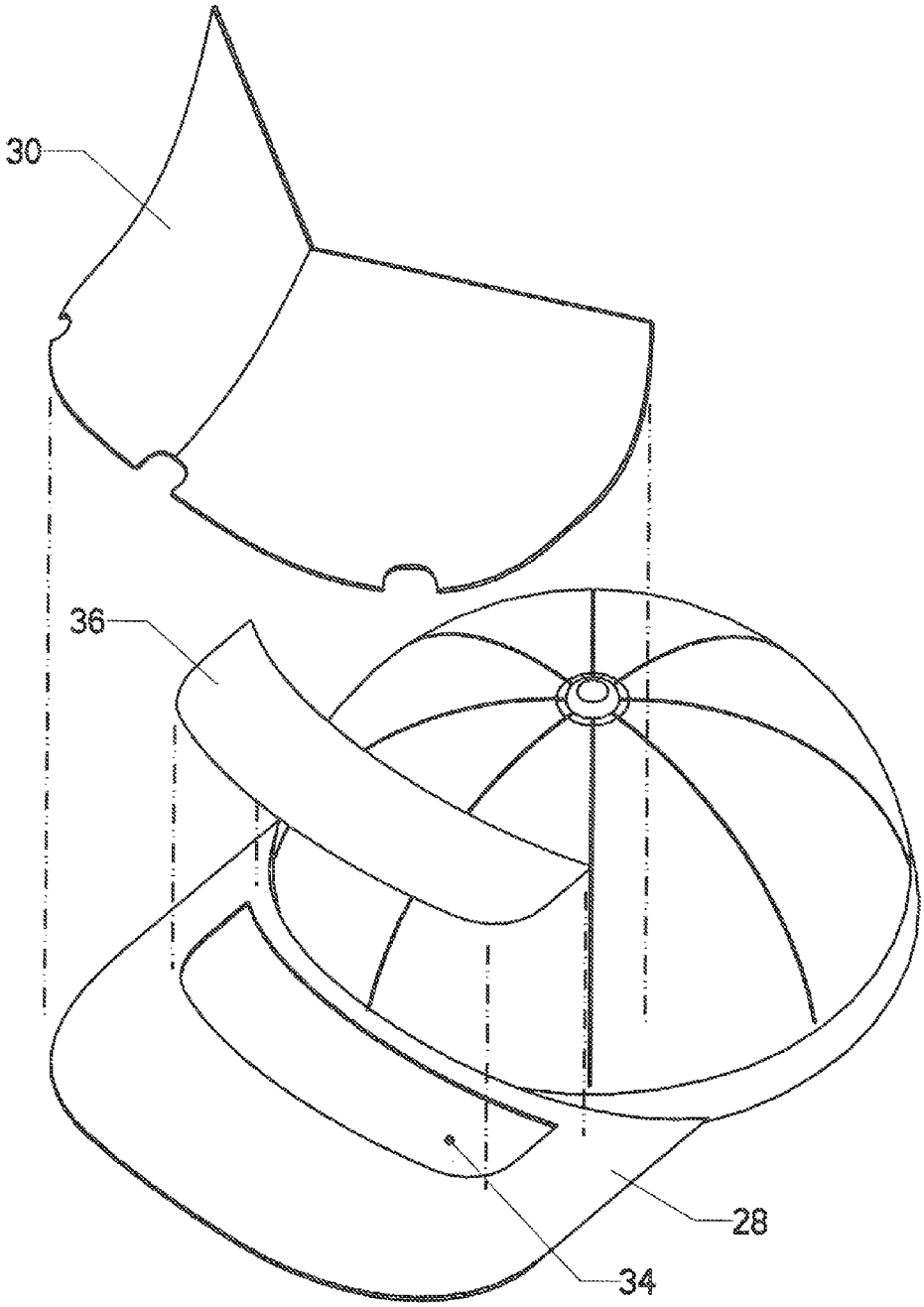
FIG. 4 is an exploded perspective view, showing the various components of the present invention.

FIG. 4 shows the same assembly in an exploded state. Modified bill 28 has vent 34 passing through it from top to bottom. This vent is preferably covered by flap 36. Downforce generator 30 then lies above the location of the forward portion of the flap. The invention can be made in a variety of sizes. The absolute dimensions are not as important as the ratios between certain dimensions, as will be explained subsequently. However, it may be helpful or the reader to understand some typical dimensions based on a typical cap size.

The width of bill 14 is preferably between about 15 cm and 25 cm. The length of the bill is preferably between about 6 cm (a "short bill") and about 14 cm (a "fishing bill"). The width and length of vent 34 is obviously less than that of the bill. The width of vent 34 is between about 12 cm and about 21 cm. The slot is preferably between 1.5 cm and 3 cm across. Flap 36 preferably covers the entire slot. Thus, flap 36 is preferably between about 13 cm and about 22 cm wide. It is preferably between 1.6 cm and 4 cm across.

Figure 5:
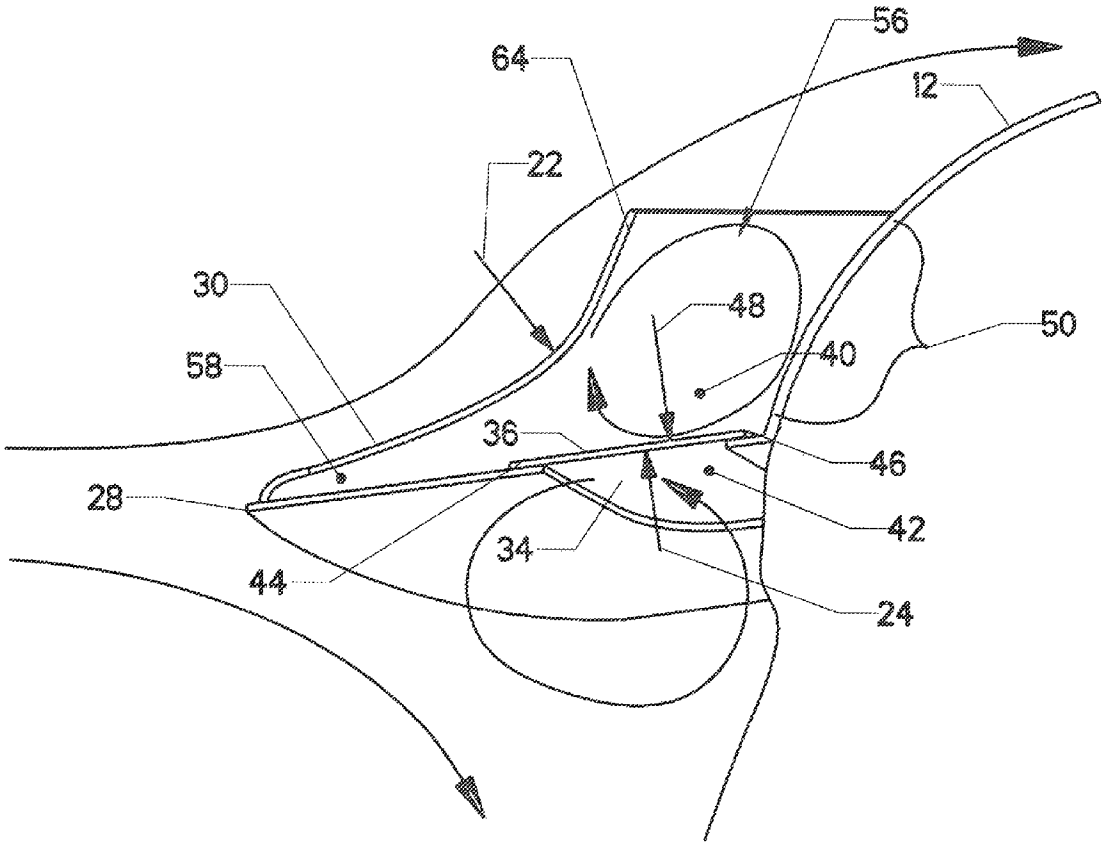
FIG. 5 is a detail view, showing the operation of the downforce generator and the vent.

FIG. 5 shows a section elevation view through modified bill 28 in the region of vent 34 (with the vent in a closed state). The reader will observe that downforce generator 30 is a thin-walled structure rising upward and rearward from the leading edge of modified bill 28. Cavity 58 is formed by downforce generator 30 and modified bill 28. The reader will observe that the downforce generator extends only part of the way from the leading edge of modified bill 28 to forward region 50 of head covering 12. Thus, gap 56 is formed between the trailing edge of the downforce generator and forward region 50. The shape of the downforce generator is significant. The upward curvature of the downforce generator increases to a maximum in trailing region 64. The significance of this feature will be explained subsequently.

The presence of gap 56 creates a recirculation zone behind the trailing edge of the downforce generator. The airstream impacting the upwardly inclined forward surface of the downforce generator creates downforce 22 (through stagnation pressure of the air impacting the device). Downforce 22 obviously tends to hold the hat down on the user's head. The creation of the recirculation zone in gap 56 tends to create relatively high pressure in this region, which places secondary downforce 48 on the upper surface of flap 36 and tends to retain the flap in the closed position when the air is passing over the bill in the fashion shown in FIG. 5.

Flap 36 is made of a flexible material. It is preferably attached to the bill by flap attachment 44 (which can be a sewn joint, an adhesive joint, etc.). The effect of this construction is that the leading edge of flap 36 remains in a fixed position with respect to the bill, but free end 46 can lift upward, thereby opening vent 34 and allowing flow to occur from below the bill to above the bill.

Figure 7:
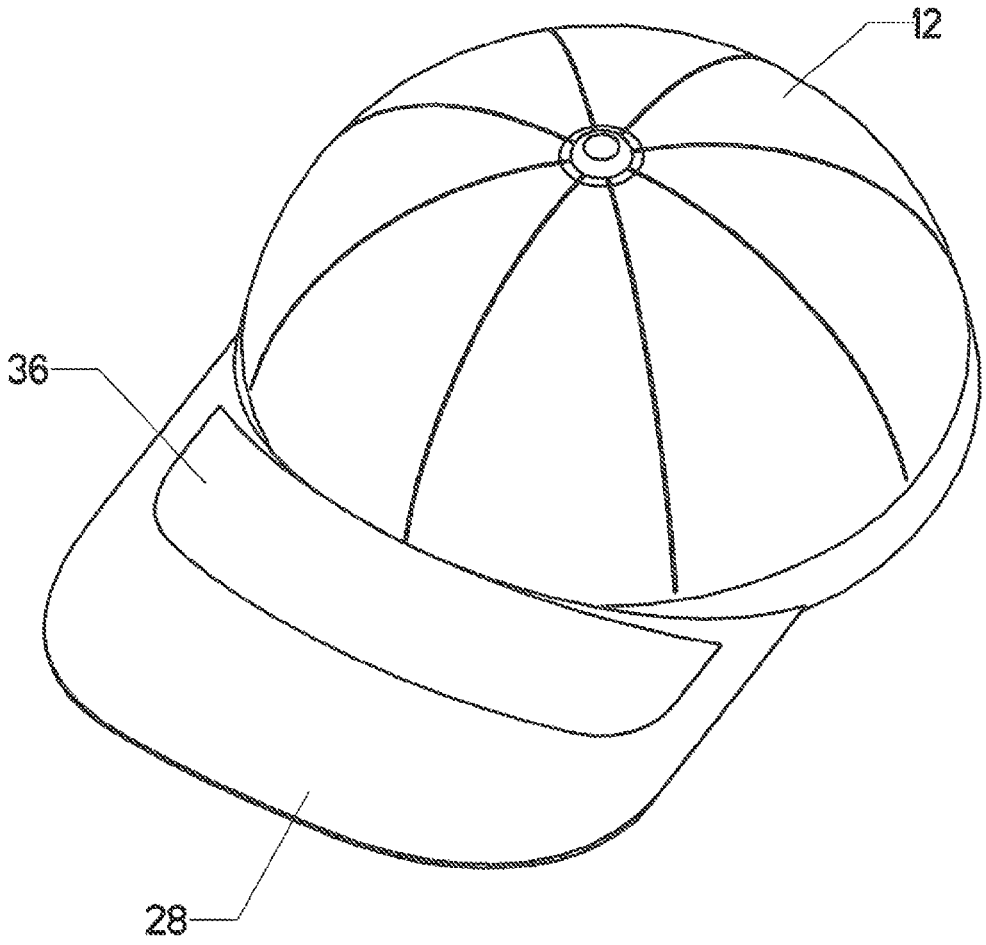
FIG. 7 is a perspective view, showing the present invention with the downforce generator removed.

In the configuration shown in FIG. 5, upper pressure 40 (the air pressure above the bill) is equal to or exceeds lower pressure 42 (the air pressure below the bill). Thus, secondary downforce 48 exceeds lift 24 and flap 36 remains closed. This represents the normal configuration. In this configuration, the hat functions as a normal baseball cap in that it does not allow sun or rain to reach the wearer's face. Free end 46 is preferably designed to rest flat against forward region 50 or the bill itself, so that rain falling down the vertical portions of the cap will not leak through vent 34. FIG. 7 shows a view of flap 36 in the closed position (with the downforce generator removed for visual clarity).

Figure 6:
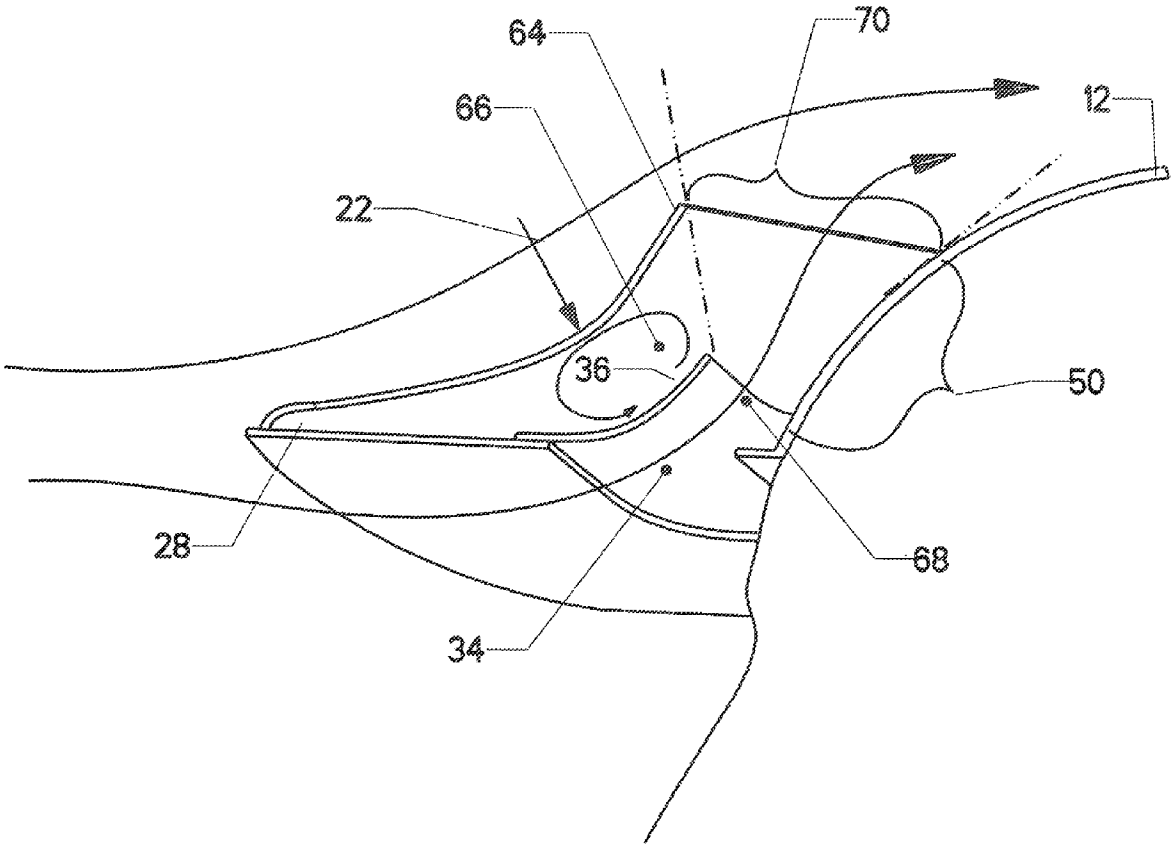
FIG. 6 is a detail view, showing the operation of the downforce generator and the vent.

In FIG. 6, the relative flow velocity or flow direction has changed so that the pressure below the vent exceeds the pressure above it. An example of a situation creating such a change is a person riding in an open boat. If the person keeps his or her head pointed straight ahead, a conventional cap will stay on. However, if the person momentarily forgets about the hat and tilts his or her head upward, the relative wind will increase the pressure underneath the bill and lift the cap off the person's head. The reader will note that in FIG. 6 the wearer's head is tilted back somewhat.

In the scenario of FIG. 6 the pressure underneath the bill exceeds the pressure above the bill. In such a case flap 36 is forced open as shown. Air then flows from beneath the bill and into gap 56, where it joins the stream passing over the top of the cap. This results in a significant reduction in lifting force. Meanwhile, the air flowing over the downforce generator continues to produce downforce 22. Those skilled in the art will therefore realize that by appropriately sizing and shaping the elements disclosed, it is possible for downforce 22 to exceed the lifting force in nearly all configurations. Thus, the cap has a much greater tendency to stay on the wearer's head.

The relative scaling of the geometry of the vent, the downforce generator, and the cap is important to the operation of the device. Returning briefly to FIG. 5, the reader will recall that flap 36 is attached to bill 14 along flap attachment 44. Flap attachment 44 is preferably a secured seam, where the two pieces of material—one from the flap and one from the bill—are overlapped for some distance and joined together. Such a seam tends to help hold the flap closed, as the flap material itself must bend in order to open vent 34.

This phenomenon is shown in FIG. 6, where the reader will observe that flap 36 has to bend in order to open vent 34. This naturally produces a curved shape to the opening. The result is a crude form of venturi. Flexible flap 36 bends until its trailing edge is approximately parallel to (within ten degrees of parallel) the adjacent portion of forward region 50. The air enters through vent 34, passes through throat 68, and passes out through exit 70. A recirculation zone is created on the back side of flap 36, as indicated by the circular arrow. The phantom line shows the approximate boundary of the expanding air as it moves through throat 68 toward exit 70. The opposite boundary of the expanding air is of course formed by forward region 50 of the cap itself.

The flow through the venturi is governed by Bernoulli's Equation, which is restated below:

$$\frac{1}{2}v_1^2 + gh_1 + \frac{P_1}{\rho_1} = \frac{1}{2}v_2^2 + gh_2 + \frac{P_2}{\rho_2}$$

The left side of the equation represents a first position in the moving flow and the right side represents a second position in the moving flow. From the equation, one may easily perceive that as flow velocity increases, the pressure of the moving air decreases. The flow velocity is greatest in the region of throat 68 (as for any venturi) and as a result this is the region of lowest pressure. The flow velocity in the recirculating region behind flap 36 is nearly zero, and the pressure in that region is much higher. The differential pressure results in the creation of closing pressure 66, which tends to force the flap closed again.

The differential pressure created by the venturi effect causes the flap to close significantly faster than gravity alone. The result is that less pressure (under the bill) is required to open the flap than is required to hold it open. A quick uplifting pressure is generally what blows the cap off the wearer's head. The present venturi design rapidly opens. However—unless a sustained flow is passing through the vent—it will rapidly close again. This means that the venturi design provides the desired rapid pressure relief while also quickly returning to the closed state in order to provide sun shade and rain exclusion.

In order to create the desired effect, the geometry of the flap and exit must be appropriately sized. In the embodiment of FIG. 6, the vent and flap are sized to produce a throat 68 opening that is about 1.8 cm across. Trailing portion 64 is separated from forward region 50 enough to make exit about 3.6 cm across. Those skilled in the art will know that the significant geometry is the area of the throat compared to the area of the exit (an "area ratio"). Since the components all have about the same width (across the front of the cap), the area ratio turns into a function based on the distance across the throat compared to the distance across the exit.

The throat area is $W_t \cdot L_t$, while the area of the exit is $W_e \cdot L_e$, where W is width, L is length, t stands for throat, and e stands for exit. If the length of the throat is the same as the length of the exit (which is roughly true), then the area ratio may be simplified to the distance across the exit divided by the distance across the throat. This ratio is preferably maintained between 2 to 1 and 4 to 1. Thus, in the embodiment of FIG. 6, the throat is configured to be 1.8 cm across while the exit is configured to be 3.6 cm across (a ration of 2 to 1).

Returning now to FIG. 5, some addition features of the invention will be discussed. The reader will observe that downforce generator 30 is preferably a thin walled structure. It is preferably attached near the bill's leading edge. This fact creates cavity 58 between the bill and the downforce generator. Depending on the configuration of the bill, this cavity may trap rainwater. Thus, in some embodiments a drain is desirable. Turning now to FIG. 3, the reader will note the inclusion of three drains 38 through the downforce generator. These allow rain flowing off the head covering and bill to escape cavity 58.

Figure 8:
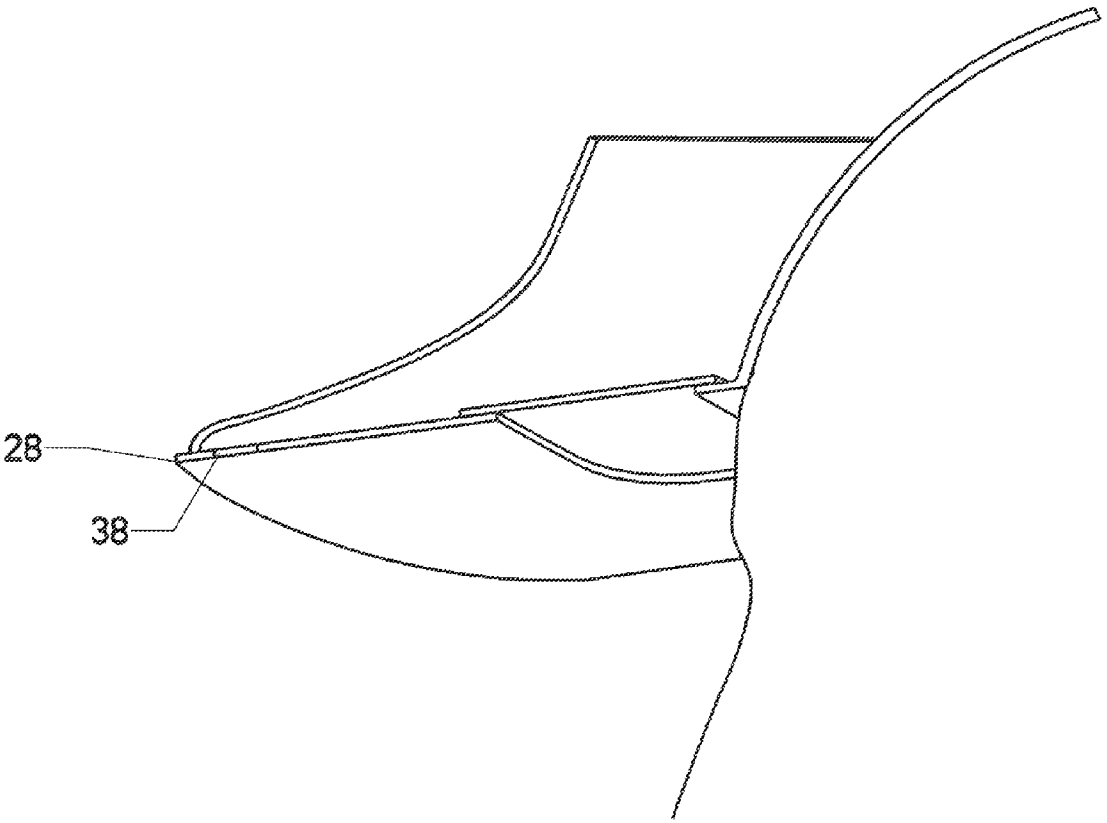
FIG. 8 is a side elevation view, showing an alternate embodiment.

FIG. 8 shows an alternate location for the drain. In this embodiment, drain 38 passes through the bill. The drain can be placed in any convenient location, so long as it allows water collecting in cavity 58 to exit.

Although the preceding description contains significant detail, it should not be construed as limiting the scope of the invention but rather as providing illustrations of the preferred embodiments of the invention. As an example, although the invention has been illustrated with a thin walled downforce generator, a solid or thick-walled design made of lightweight foam material could be substituted. Many other variations will be apparent to those skilled in the art. Thus, the scope of the invention should be fixed by the following claims rather than any specific examples provided.

Having described my invention, I claim:

1. A baseball cap, comprising:

a. a head covering, including a forward region;

b. a bill extending outward from said forward region of said head covering, said bill having a leading edge distal to said head covering and a trailing edge proximal to said head covering;

c. a downforce generator, extending upward from said bill, wherein said downforce generator extends only part of the way from said leading edge of said bill to said forward region of said head covering and ending in a trailing portion, thereby creating a gap between said trailing portion of said downforce generator and said forward region of said head covering with said gap having a distance across said gap;

d. a vent, extending through said bill into said gap, with said vent having a forward portion and a rearward portion;

e. a flexible flap lying across said vent, with said flexible flap having a forward edge and a trailing edge;

f. said forward edge of said flexible flap being joined to said bill proximate said forward portion of said vent;

g. said flexible flap being bendable into an open configuration wherein said trailing edge of said flap is approximately parallel to said forward region of said head covering, thereby forming a throat between said flexible flap and said forward region of said head covering, said throat having a distance across said throat;

h. wherein said distance across said throat is between about ½ and ¼ said distance across said gap;

i. wherein said downforce generator has a middle portion, a first side extreme, and a second side extreme; and j. wherein said downforce generator has a splitter located in said middle portion, with said splitter being configured to divide said air flow into a first portion directed toward said first side extreme and a second portion directed toward said second side extreme.

2. A baseball cap as recited in claim 1 wherein:

a. said downforce generator is a thin structure attached along said leading edge of said bill, thereby forming a cavity between said downforce generator and said bill: and b. said downforce generator includes a drain passing through said downforce generator, thereby draining said cavity.

* * * * *